US009890979B2

(12) United States Patent
McMasters et al.

(10) Patent No.: US 9,890,979 B2
(45) Date of Patent: Feb. 13, 2018

(54) SYSTEM AND METHOD FOR VENTING REFRIGERANT FROM AN AIR CONDITIONING SYSTEM

(71) Applicants: Bosch Automotive Service Solutions LLC, Warren, MI (US); Robert Bosch GmbH, Stuttgart (DE)

(72) Inventors: Mark W. McMasters, Owatonna, MN (US); Dylan M. Lundberg, Lonsdale, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 216 days.

(21) Appl. No.: 14/925,271

(22) Filed: Oct. 28, 2015

(65) Prior Publication Data

US 2016/0123641 A1 May 5, 2016

Related U.S. Application Data

(60) Provisional application No. 62/073,375, filed on Oct. 31, 2014.

(51) Int. Cl.
*F25B 45/00* (2006.01)

(52) U.S. Cl.
CPC ..... *F25B 45/00* (2013.01); *F25B 2345/002* (2013.01); *F25B 2345/003* (2013.01); *F25B 2345/006* (2013.01); *F25B 2345/007* (2013.01); *F25B 2345/0052* (2013.01)

(58) Field of Classification Search
CPC ..... F25B 45/00; F25B 2345/007; F25B 2345/006; F25B 2345/003; F25B 2345/002
See application file for complete search history.

(56) References Cited

U.S. PATENT DOCUMENTS 5,263,331 A * 11/1993 Sergius ..... F25B 45/00 62/292
5,425,242 A * 6/1995 Dunne ..... B01D 15/00 62/636
2009/0293517 A1* 12/2009 Bittner ..... F25B 25/005 62/171

* cited by examiner

*Primary Examiner* — Len Tran
*Assistant Examiner* — Ana Vazquez
(74) *Attorney, Agent, or Firm* — Maginot Moore & Beck LLP

(57) ABSTRACT

An air conditioning service system includes an inlet port configured to connect to an air conditioning system to receive refrigerant, a discharge circuit, a pressure transducer, and a controller. The discharge circuit includes a plurality of discharge lines arranged in parallel with one another, each of the plurality of discharge lines fluidly connecting the inlet port to the atmosphere through an associated orifice to vent the refrigerant to atmosphere, and a plurality of discharge valves, each of which is configured to open and close an associated one of the plurality of discharge lines. The controller is configured to obtain the pressure at the inlet port and determine a theoretical mass flow rate through each of the plurality of discharge lines based upon the pressure and the cross-sectional area of the associated orifice, and to operate selected ones of the discharge valves based upon the determined theoretical mass flow rates.

5 Claims, 7 Drawing Sheets

SYSTEM AND METHOD FOR VENTING REFRIGERANT FROM AN AIR CONDITIONING SYSTEM

CLAIM OF PRIORITY

This application claims priority to U.S. Provisional Application Ser. No. 62/073,375 entitled "System and Method for Venting Refrigerant from an Air Conditioning System," filed Oct. 31, 2014, the disclosure of which is hereby incorporated herein by reference in its entirety.

TECHNICAL FIELD

This disclosure relates generally to refrigeration systems, and more particularly to refrigerant service systems for refrigeration systems.

BACKGROUND

Air conditioning systems are currently commonplace in homes, office buildings and a variety of vehicles including, for example, automobiles. Over time, the refrigerant included in these systems becomes depleted and/or contaminated. As such, in order to maintain the overall efficiency and efficacy of an air conditioning system, the refrigerant in the system is periodically replaced or recharged.

Portable carts, also known as recover, recycle, recharge ("RRR") refrigerant service carts, or air conditioning service ("ACS") units, are used in connection with servicing refrigeration circuits, such as the air conditioning unit of a vehicle. The portable machines include hoses coupled to the refrigeration circuit to be serviced. In some current refrigeration systems the refrigerant, for example R134a or R1234yf, used is expensive and can be hazardous if released into the atmosphere. As such, a vacuum pump and compressor operate to recover refrigerant from the vehicle's air conditioning unit, flush the refrigerant, and subsequently store the recovered refrigerant in a refrigerant tank. The refrigerant can then be used in another refrigeration system. Recovering the refrigerant, however, requires the ACS unit to include filters, heat exchangers, a compressor, a storage tank, and a scale to weigh the storage tank.

Some newer air conditioning systems have begun using R744, or carbon dioxide, as an economical and eco-friendly refrigerant alternative. Removal of the R744 refrigerant from these air conditioning systems is done by venting the refrigerant to the atmosphere in a controlled manner. The R744, however, is at a very high static pressure in the air conditioning system at ambient conditions, such that the venting of the refrigerant must be controlled to prevent damage to components or elastomeric seals in the air conditioning system. What is needed, therefore, is an ACS unit that can accurately determine the flow rate of refrigerant vented from an air conditioning system during a service operation.

Additionally, it is advantageous to measure the total mass discharged from the air conditioning system to aid in diagnostics of the air conditioning system, for example to determine if the system has a leak. Since the R744 refrigerant is vented to atmosphere, and not captured, it is difficult or impossible in conventional ACS units to accurately determine the quantity of refrigerant removed from the air conditioning system during the venting. What is needed, therefore, is an ACS unit that can accurately determine total mass of R744 refrigerant vented from an air conditioning system during a service operation.

SUMMARY

In one embodiment, an air conditioning service system comprises an inlet port, a discharge circuit, a pressure transducer, and a controller. The inlet port is configured to connect to an air conditioning system to receive refrigerant and the pressure transducer is configured to sense a pressure at the inlet port. The discharge circuit includes a plurality of discharge lines arranged in parallel with one another. Each of the plurality of discharge lines fluidly connects the inlet port to the atmosphere through an associated orifice having a cross-sectional area to vent the refrigerant to atmosphere. The discharge unit further includes a plurality of discharge valves, each of which is associated with one of the plurality of discharge lines and is configured to open and close the associated one of the plurality of discharge lines. The controller is operably connected to the pressure transducer and to each of the plurality of discharge valves. The controller includes a memory and a processor configured to execute program instructions stored in the memory to obtain the sensed pressure at the inlet port and determine a theoretical mass flow rate through each of the plurality of discharge lines based upon the sensed pressure and the cross-sectional area of the associated orifice, and to operate selected ones of the plurality of discharge valves based upon the determined theoretical mass flow rates.

In some embodiments, the controller is configured to determine a first set of the plurality of discharge valves having a combined theoretical flow rate that is less than a predetermined maximum flow rate, and to operate the first set of the plurality of discharge valves to open. In a further embodiment, the controller is configured to determine the first set of the plurality of discharge valves such that the total theoretical flow rate of the valves of the first set is a maximum possible combined theoretical flow rate that is less than the predetermined maximum flow rate.

In yet another embodiment of the air conditioning service system, the controller is further configured to determine a first mass flow through the first set of the plurality of discharge valves during a first time period, and to store the mass flow in the memory. In some embodiments, the controller is further configured to determine a total mass by summing a plurality of mass flows determined during a venting operation.

A method according to the disclosure for venting refrigerant from an air conditioning system comprises sensing a pressure of a refrigerant at an inlet port of an air conditioning service system that is connected to an air conditioning system to receive refrigerant therefrom, and determining a theoretical mass flow rate through each discharge line of a plurality of discharge lines based upon the sensed pressure and a cross-sectional area of an associated orifice arranged in the discharge line, wherein the plurality of discharge lines are arranged in parallel with one another in a discharge circuit and each of the plurality of discharge lines connecting the inlet port to the atmosphere through the associated orifice. The method further comprises operating a plurality of discharge valves, each of the plurality of discharge valves being configured to open and close an associated one of the plurality of discharge lines, based upon the determined theoretical mass flow rates, and discharging refrigerant to atmosphere through selected ones of the plurality of discharge valves that are open.

In another embodiment the method further comprises determining a first set of the plurality of discharge valves having a combined theoretical flow rate that is less than a predetermined maximum flow rate, and the operating of the plurality of discharge valves includes operating the first set of the plurality of discharge valves to open.

In yet another embodiment of the method, the determining of the first set of the plurality of discharge valves includes determining the first set having a maximum possible total combined theoretical flow rate that is less than the predetermined maximum flow rate.

In some embodiments, the method further comprises determining a first mass flow through the first set of valves during a first time period and storing the mass flow in a memory. In one embodiment, the method further comprises determining a total mass by summing a plurality of mass flows determined during a venting operation and storing the total mass in the memory.

In another embodiment according to the disclosure, an air conditioning service system comprises an inlet port configured connect to an air conditioning system, and a discharge circuit including a first discharge line fluidly connecting the inlet port to the atmosphere and a first discharge valve configured to open and close the first discharge line, the first discharge line including a first orifice having a first flow area. The air conditioning service system further comprises a pressure transducer configured to sense a pressure at the inlet port and a controller operably connected to the pressure transducer and configured to obtain the sensed pressure at the inlet port. The controller is further configured to determine a first theoretical mass flow rate through the first orifice based upon the sensed pressure and the first cross-sectional area, and to operate the first discharge valve based upon the first theoretical mass flow rate.

In one embodiment of the air conditioning service system, the discharge circuit further comprises a second discharge line fluidly connecting the inlet port to the atmosphere and a second discharge valve configured to open and close the second discharge line, the second discharge line including a second orifice having a second flow area, and the controller is further configured to determine a second theoretical mass flow rate through the second orifice based upon the sensed pressure and the second cross-sectional area, and to operate the first and second discharge valves based upon the first and second theoretical mass flow rates. In some embodiments, the first cross-sectional area is different from the second cross-sectional area.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
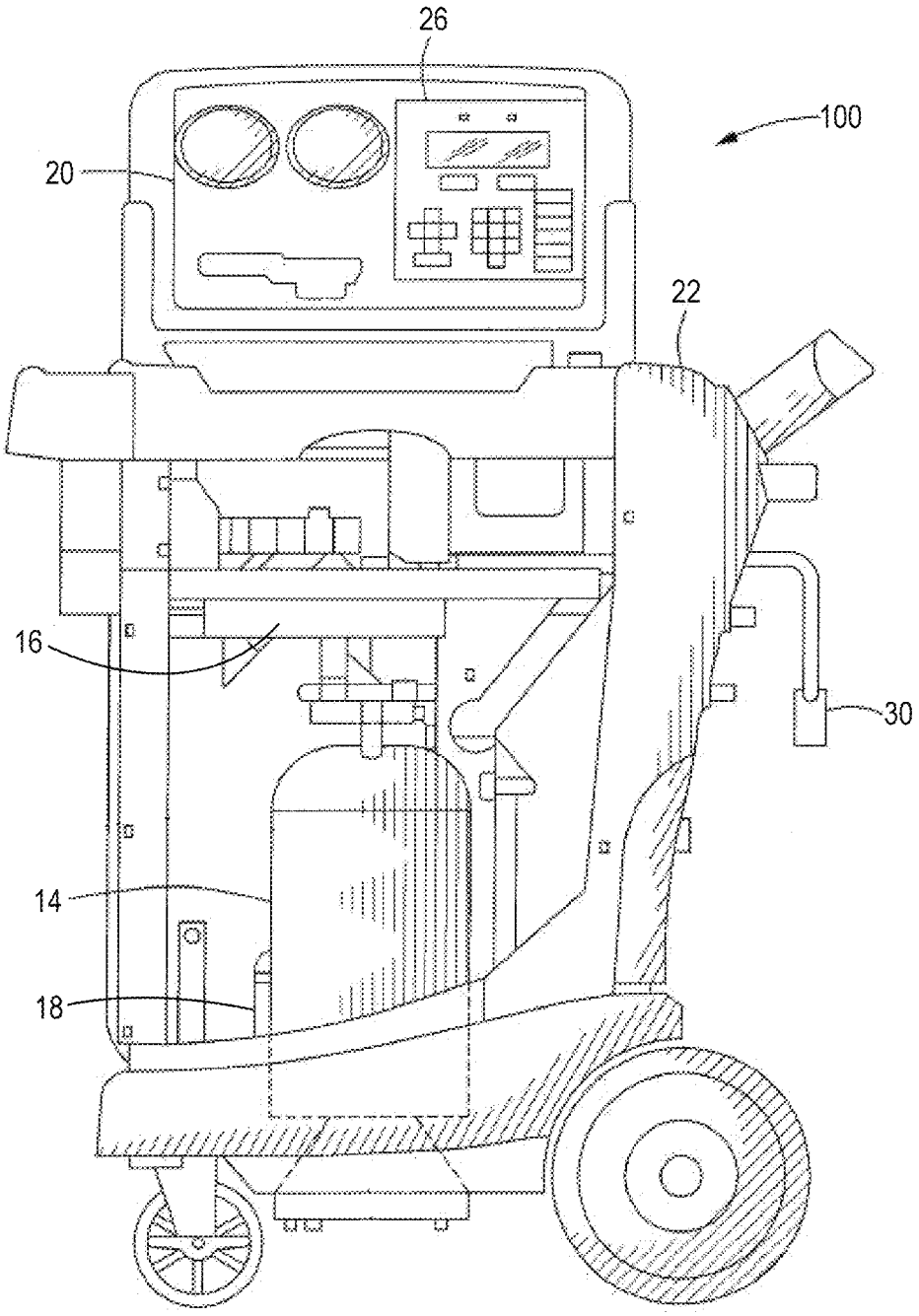
FIG. 1 is a partial cutaway front view of an ACS machine according to the disclosure.

FIG. 1 is an illustration of an air conditioning service ("ACS") system 100. The ACS system 100 includes a refrigerant container or internal storage vessel ("ISV") 14, a manifold block 16, a compressor 18, a control module 20, and a housing 22. The exterior of the control module 20 includes an input/output unit 26 for input of control commands by a user and output of information to the user. Hose connections 30 (only one is shown in FIG. 1) protrude from the housing 22 to connect to service hoses that connect to an air conditioning ("A/C") system 40 (FIG. 2) and facilitate transfer of refrigerant between the ACS system 100 and the A/C system 40. The manifold block 16 is fluidly connected to the ISV 14, the compressor 18, and the hose connections 30 through a series of valves, hoses, and tubes, which are discussed in detail below with reference to FIG. 3.

The ISV 14 is configured to store refrigerant for the ACS system 100. No limitations are placed on the kind of refrigerant that may be used in the ACS system 100. As such, the ISV 14 is configured to accommodate any refrigerant that is desired to be charged to the A/C system 40. In some embodiments, the ISV 14 is particularly configured to accommodate one or more refrigerants that are commonly used in the A/C systems of vehicles (e.g., cars, trucks, boats, planes, etc.), for example R-134a, $CO_2$ (also known as R-744), or R-1234yf. In some embodiments, the ACS system has multiple ISV tanks configured to store different refrigerants.

Figure 2:
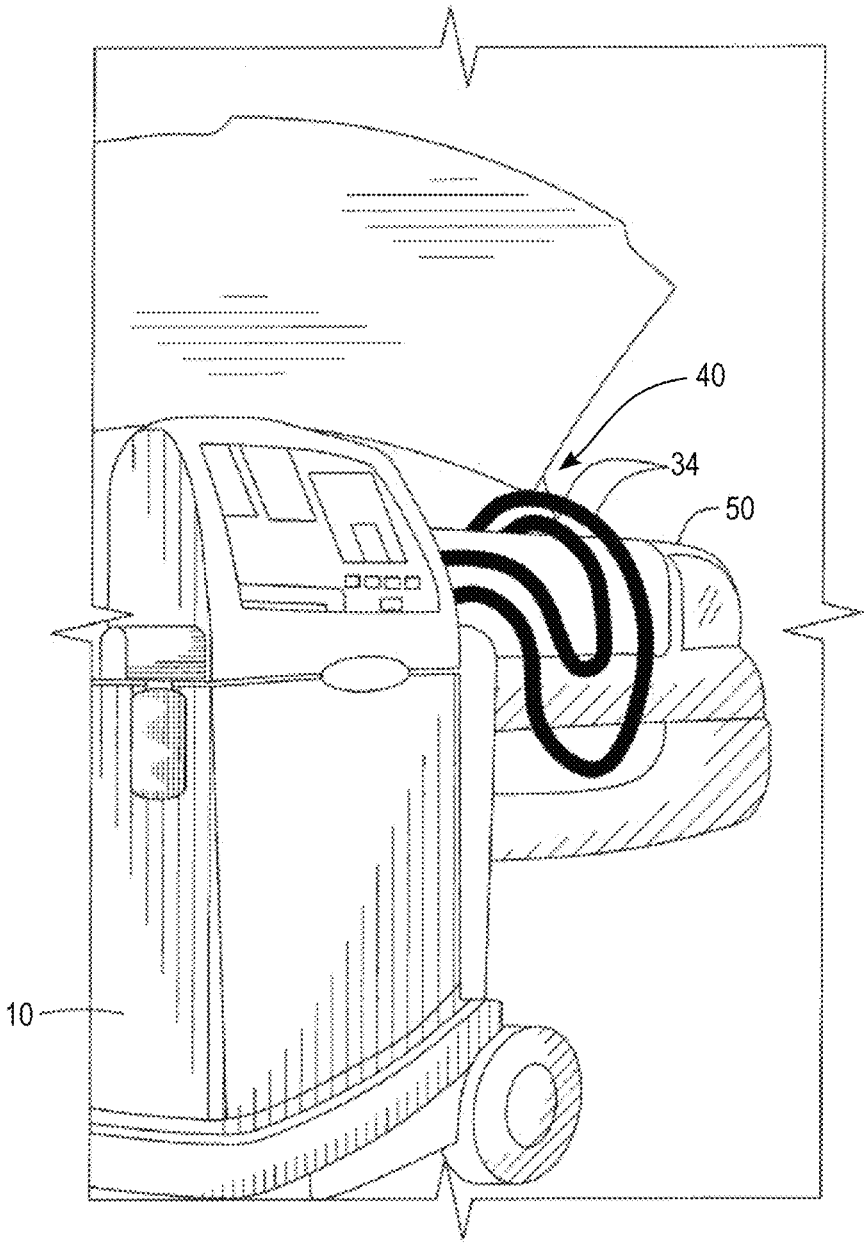
FIG. 2 is side perspective view of the ACS machine of FIG. 1 connected to a vehicle.

FIG. 2 is an illustration of a portion of the air conditioning recharging system 10 illustrated in FIG. 1 connected to the A/C system 40 of a vehicle 50. One or more service hoses 34 connect an inlet and/or outlet port of the A/C system 40 of the vehicle 50 to the hose connections 30 (shown in FIG. 1) of the ACS system 100.

Figure 3:
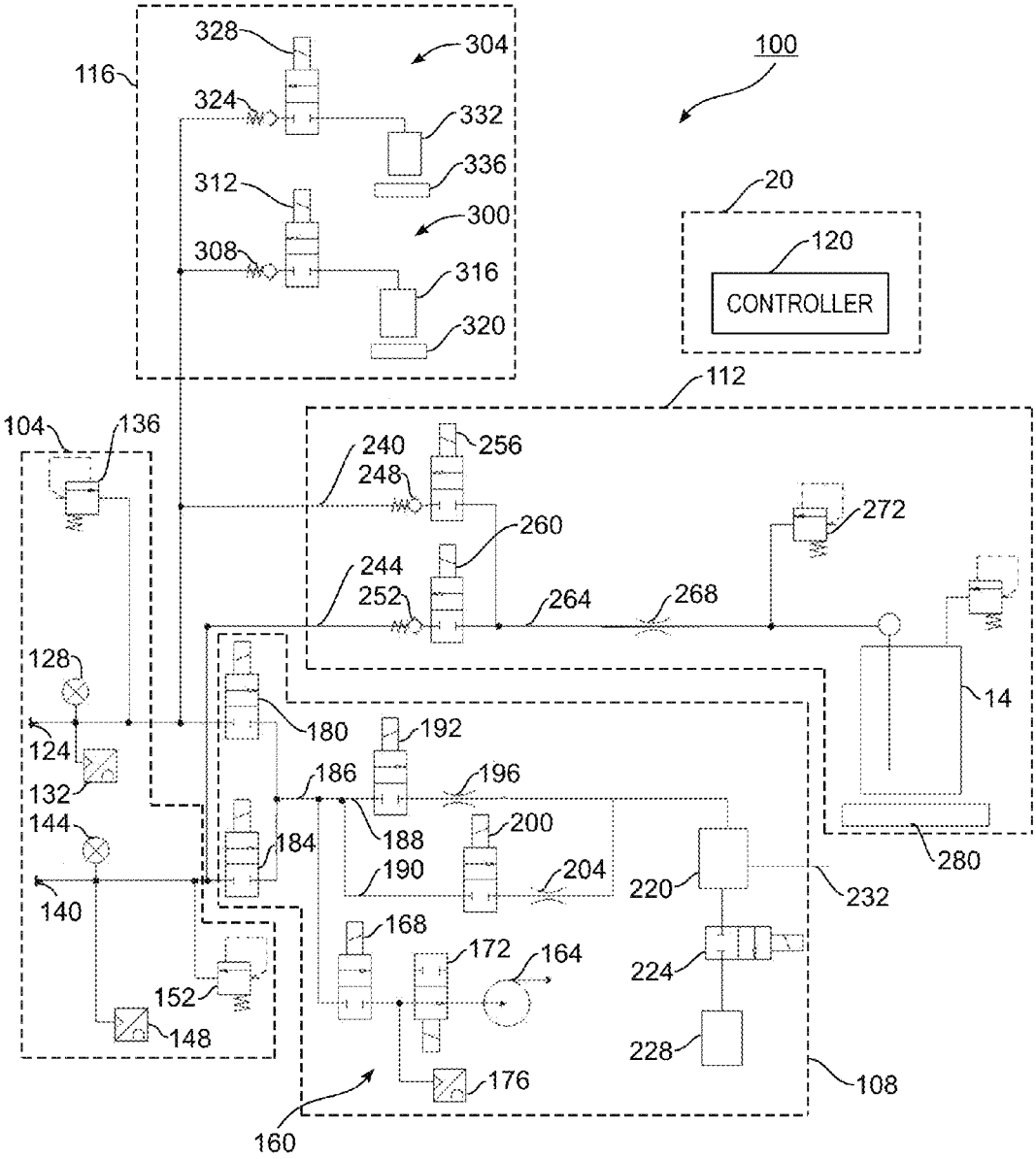
FIG. 3 is a schematic view of the ACS machine according to the disclosure configured to vent refrigerant to the atmosphere through control orifices.

FIG. 3 illustrates a schematic diagram of the ACS system 100. The ACS system 100 includes a coupling system 104, a discharge circuit 108, a charge circuit 112, an injection circuit 116, and a controller 120. The coupling system 104 includes a high-side coupler 124 connected to a high-side pressure gauge 128, a high-side pressure transducer 132, and a high-side pressure relief valve 136; and a low-side coupler 140 connected to a low-side pressure gauge 144, a low-side pressure transducer 148, and a low-side pressure relief valve 152. The low and high-side couplers 124, 140 include hose connections 30 (FIG. 2) configured to connect to the service hoses 34, to connect the ACS system 100 to an air conditioning system, for example air conditioning system 40 of vehicle 50.

Referring back to FIG. 3, the discharge circuit 108 includes a vacuum pump subsystem 160 having a vacuum pump 164, two vacuum solenoid valves 168, 172, and a vacuum transducer 176. The vacuum pump 164 is configured to produce a negative pressure in the discharge circuit 108.

The discharge circuit 108 further includes a high-side inlet solenoid valve 180 and a low-side inlet solenoid valve 184, which are connected to the high-side and low-side couplers 124, 140, respectively. The outlets of the inlet valves 180, 184 are both connected to a joint line 186, which splits into two discharge lines 188, 190, which are arranged in parallel with one another, downstream of a connection of the joint line 186 to a line connecting to the vacuum subsystem 160. A first system discharge solenoid valve 192 is configured to open and close the first discharge line 188, and a first control orifice 196 are arranged in the first discharge line 188. A second discharge solenoid valve 200 is configured to open and close the second discharge line 190, and a second control orifice 204 is arranged in the second discharge line 190. In one embodiment, the control orifices 196, 204 have different cross-sectional areas. In some embodiments, only one system discharge valve and control orifice may be included, while other embodiments may include more than two system discharge valves and corresponding control orifices and discharge lines arranged in parallel with one another.

The discharge lines 188, 190 join and connect to a system oil separator 220. The system oil separator 220 is configured to separate the refrigerant from oil entrained in the refrigerant during normal operation of the air conditioning system. The oil flows through an oil drain solenoid valve 224 into an oil drain vessel 228, while the refrigerant flows through a discharge passage 232, which is open to the atmosphere.

The charge circuit 112 includes a high-side charge line 240 connected to the high-side coupler 124 and a low-side charge line 244 connected to the low-side coupler 140. The charge lines 240, 244, respectively, each include a check valve 248, 252 allowing flow only in the direction of the couplers 124, 140, and a charge solenoid valve 256, 260 to control flow during charging. The charge lines 240, 244 connect to a joint charge line 264, which includes an inflow orifice 268 configured to control the flow rate during charging, and a pressure relief valve 272 configured to prevent excess pressure from building in the charge circuit 112. The joint charge line 264 connects to the ISV 14, which is positioned in the ACS system on a refrigerant scale 280 configured to measure the weight of refrigerant in the ISV 14.

The injection circuit 116 is connected to the high-side coupler 124 and includes an oil injection subsystem 300 and a dye injection subsystem 304. The oil injection subsystem 300 includes a check valve 308 configured to enable flow only in the direction of the high-side coupler 124, an oil injection solenoid valve 312 configured to regulate flow of oil, an oil vessel 316, and an oil vessel scale 320 configured to measure the weight of the oil vessel 316. The oil injection subsystem 300 is configured to replenish oil that is entrained in the refrigerant removed from the air conditioning system to ensure proper operation of the air conditioning system.

The dye injection subsystem 304 includes a check valve 324 configured to enable flow only in the direction of the high-side coupler 124, a dye injection solenoid valve 328 configured to regulate flow of oil, a dye vessel 332, and a dye vessel scale 336 configured to measure the weight of the dye vessel 332. The dye injection subsystem is configured to inject dye into the air conditioning system to enable a technician to perform diagnostic operations, for example detecting leaks in the air conditioning system.

Figure 4:
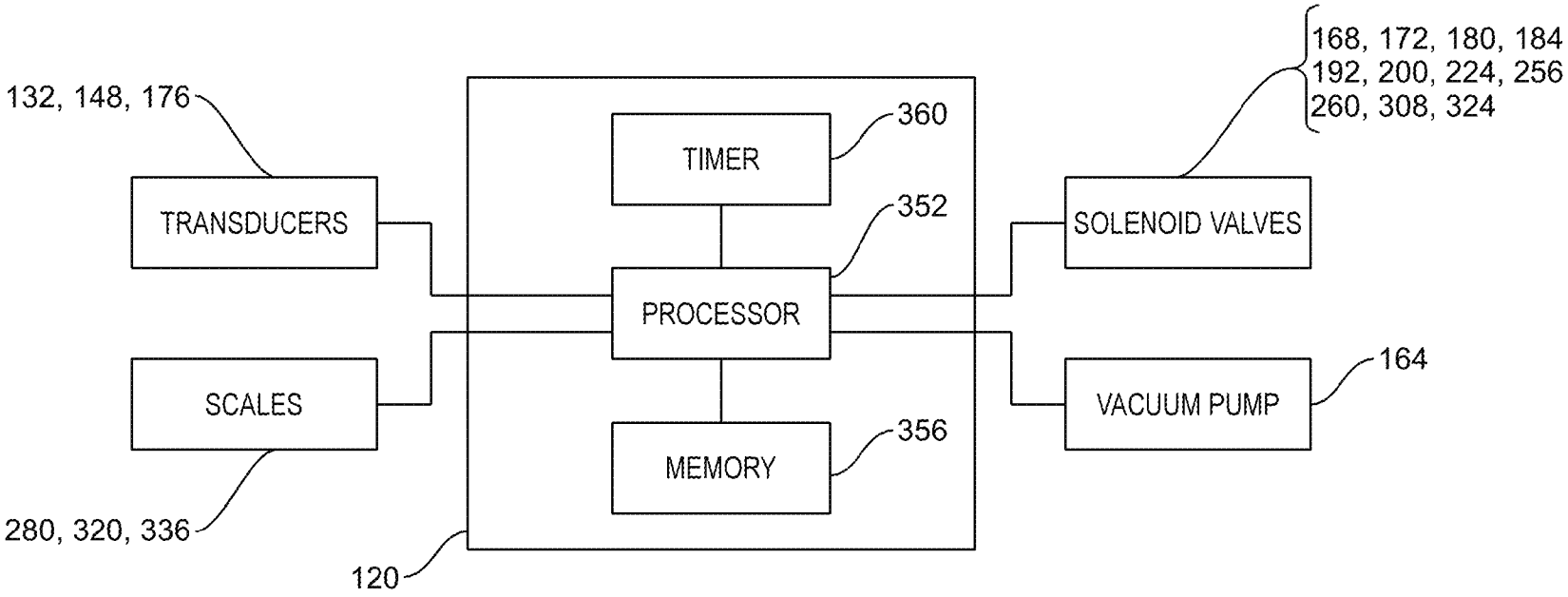
FIG. 4 is a schematic view of the control components of the ACS machine of FIG. 3.

FIG. 4 is a schematic diagram of the controller 120 and the components operably connected to the controller 120 in the ACS system 100. Operation and control of the various components and functions of the ACS system 100 are performed with the aid of the controller 120. The controller 120 is implemented with a general or specialized programmable processor 352 that executes programmed instructions. In some embodiments, the controller includes more than one general or specialized programmable processor. The instructions and data required to perform the programmed functions are stored in a memory unit 356 associated with the controller 120, which may be integral with the controller 120 (as shown in FIG. 4) or may be a separate unit. The processor 352, memory 356, and interface circuitry configure the controller 120 to perform the functions and processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The pressure transducers 132, 148, 176 are configured to transmit electronic signals representing the sensed pressure at their respective locations to the processor 352, and the refrigerant scale 280 and the injection scales 320, 336 transmit electronic signals representing the sensed weight in the ISV 14, the oil vessel 316, and the dye vessel 332, respectively, to the processor 352. The processor 352 obtains the signals from the pressure transducers 132, 148, 176 and scales 280, 320, 336 at predetermined time intervals or as necessary to perform computations, and stores relevant values from the transducers and scales in the memory 356.

The processor 352 is also electrically connected to the solenoid valves 168, 172, 180, 184, 192, 200, 224, 256, 260, 308, 324, and is configured to transmit electronic signals that instruct the valves to operate to open or close. The processor 352 is further connected to the vacuum pump 164 and is configured to transmit electronic signals to operate the vacuum pump 164 to activate and deactivate. The controller 120 also includes a timer 360, which may be integral with the controller 120, as illustrated in FIG. 4, or may be embodied as a separate timer circuit.

During a refrigerant servicing operation, the ACS system 100 is configured to vent the refrigerant in the air conditioning system, for example R744 (carbon dioxide), to the atmosphere. A technician connects the high-side coupler 124 and the low-side coupler 140 to the high-side and low-side ports of the air conditioning system via service hoses. The controller 120 then operates one or both of the high-side inlet solenoid valve 180 and low-side inlet solenoid valve 184 to open, fluidly connecting the joint line 186 to the high-side or low-side, respectively, of the air conditioning system. The controller 120 operates at least one of the discharge solenoid valves 192, 200 to open. Refrigerant then flows through the associated control orifice 196, 204, through the system oil separator 220, and is vented to atmosphere via the discharge passage 232.

The mass flow rate through an orifice is defined as a change in mass over a specified time interval. During the venting of the refrigerant from the system, the mass of the refrigerant vented can be determined if the mass flow rate of the refrigerant leaving the system and the duration of the venting are both known. The controller 120 is configured to track the duration of the vent by utilizing the timer 360. The controller 120 is configured use the vent duration to calculate the mass flow rate ($\dot{m}$), which is defined as the change in mass (m) over time (t).

$$\dot{m} = \frac{\Delta m}{\Delta t}$$

If the pressure in the air conditioning system is supersonic, or greater than approximately 1.9 times the atmospheric pressure, flow through the orifice 196 or 204 is choked, or restricted. The mass flow rate can therefore be calculated using the choked orifice flow equation:

$$\dot{m} = C * A * \sqrt{k * \rho * P_1 \left(\frac{2}{k+1}\right)^{\frac{k+1}{k-1}}}$$

where C is a discharge coefficient based on the type of flow through the orifice, A is the cross-sectional area of the orifice, k is the specific heat of the refrigerant, ρ is the density of the refrigerant, and $P_1$ is the upstream pressure, as measured by the pressure transducer 132, 148 corresponding to the inlet valve 180, 184, respectively, that is open. When the pressure upstream of the orifice falls below 1.9 times the atmospheric pressure, the flow is no longer choked by the orifice, and the following subsonic mass flow equation is used to determine the mass flow rate:

$$\dot{m} = \rho * A * \sqrt{\frac{2 * (P_1 - P_2)}{\rho}}$$

where $P_2$ is the atmospheric pressure.

Since the mass flow rate is equal to the change in mass (Δm) over the change in time (Δt), the change in mass is equal to the mass flow rate multiplied by the time elapsed.

$$\Delta m = \dot{m} * \Delta t$$

Substituting the above flow equations into the change in mass equation, the change in mass during a venting operation can be calculated as:

$$\Delta m = \left(C * A * \sqrt{k * \rho * P_1 \left(\frac{2}{k+1}\right)^{\frac{k+1}{k-1}}}\right) * \Delta t$$

for supersonic flow through the orifice, and $$\Delta m = \left(\rho * A * \sqrt{\frac{2 * (P_1 - P_2)}{\rho}}\right) * \Delta t$$

for subsonic flow.

For systems having multiple vent orifices, for example the system depicted in FIG. 3 having two orifices 196, 204, the mass flow through each individual orifice is calculated using the above equations, and the total mass vented from the system is the sum of the mass vented through each individual orifice. Any desired number of orifices having various diameters may therefore be used in the system to more precisely control the flow of refrigerant to the atmosphere.

In some embodiments, the mass flow rate is kept below a predetermined threshold, which may be approximately 100-140 grams per second in one embodiment, and which may be 120 grams per second in another specific embodiment, to prevent damage to the components and elastomeric seals of the air conditioning system as the system is vented. It is also advantageous, however, to keep the mass flow rate as close as possible to this predetermined maximum in order to vent the refrigerant from the system as quickly as possible. The solenoid valves corresponding to the orifices are therefore controlled to vent the refrigerant from the air conditioning system at a flow rate that is as close as possible to, without exceeding, the predetermined threshold.

Figure 5:
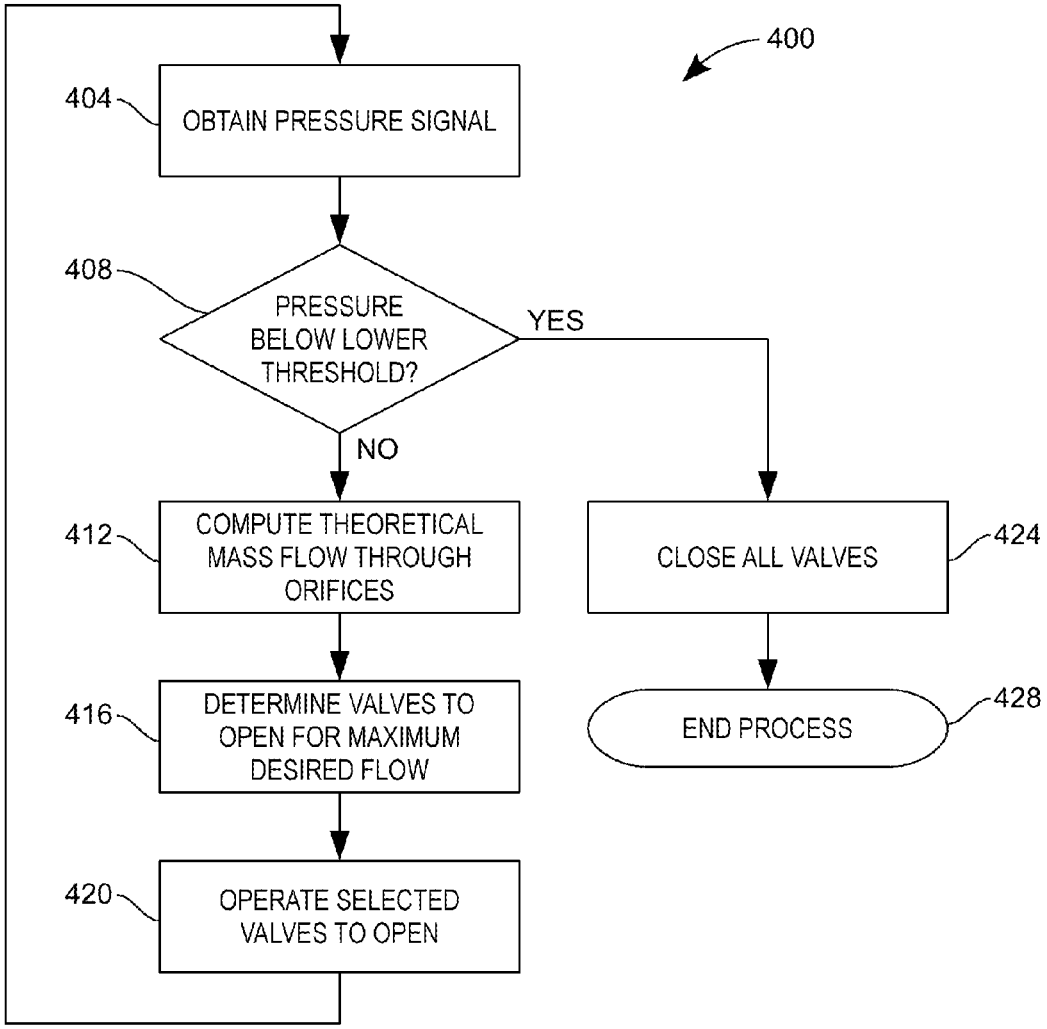
FIG. 5 is a process diagram of a method of operating an ACS machine during a venting operation.

FIG. 5 illustrates a method 400 of operating an embodiment of an ACS system, such as the ACS unit 100 described above with reference to FIGS. 3 and 4, during a venting operation. The processor 352 in the controller 120 is configured to execute programmed instructions stored in the memory 356 to operate the components in the ACS unit 100 to implement the method 400.

The process 400 begins with the controller obtaining the pressure signal (block 404). The pressure signal is obtained from a pressure transducer upstream of the orifices. In the example of FIG. 3, the pressure signal is obtained from the pressure transducer 132 or 148 corresponding to the inlet valve 180 or 184, respectively, that is open. Next, the controller determines whether the pressure upstream of the orifices is below a lower pressure threshold (block 408).

If the pressure is above the lower threshold, meaning that there is enough refrigerant remaining in the system for the venting operation to continue, then the controller proceeds to compute a theoretical mass flow through the orifices (block 412). The theoretical mass flow through the orifices is based on the pressure reading obtained upstream of the orifices and the supersonic and subsonic orifice flow equations discussed above. The ACS system may contain any number of orifices having a variety of different areas, and the theoretical mass flow calculation is performed for each of the orifices individually. The controller then determines the valves that should be opened to obtain the maximum flow of refrigerant out of the system without exceeding a maximum flow threshold (block 416). The controller determines which combination of discharge valves are to be opened to maximize the flow, and thus reduce the total time needed for venting the refrigerant, without exceeding the predetermined threshold at which the flow can cause damage to the components and elastomeric seals in the ACS system. Once the controller determines which valves to open for maximum desired flow, the controller proceeds to operate the selected valves to open (block 420) and the process continues at block 404.

Once the pressure has dropped below the lower threshold (block 408), the flow through the orifices is essentially negligible, and the controller operates the valves to close (block 424). The venting operation is then complete (block 428). The process may then be initiated again for the other circuit, for example the low-side of the air conditioning system if the high-side was previously vented.

Figure 6:
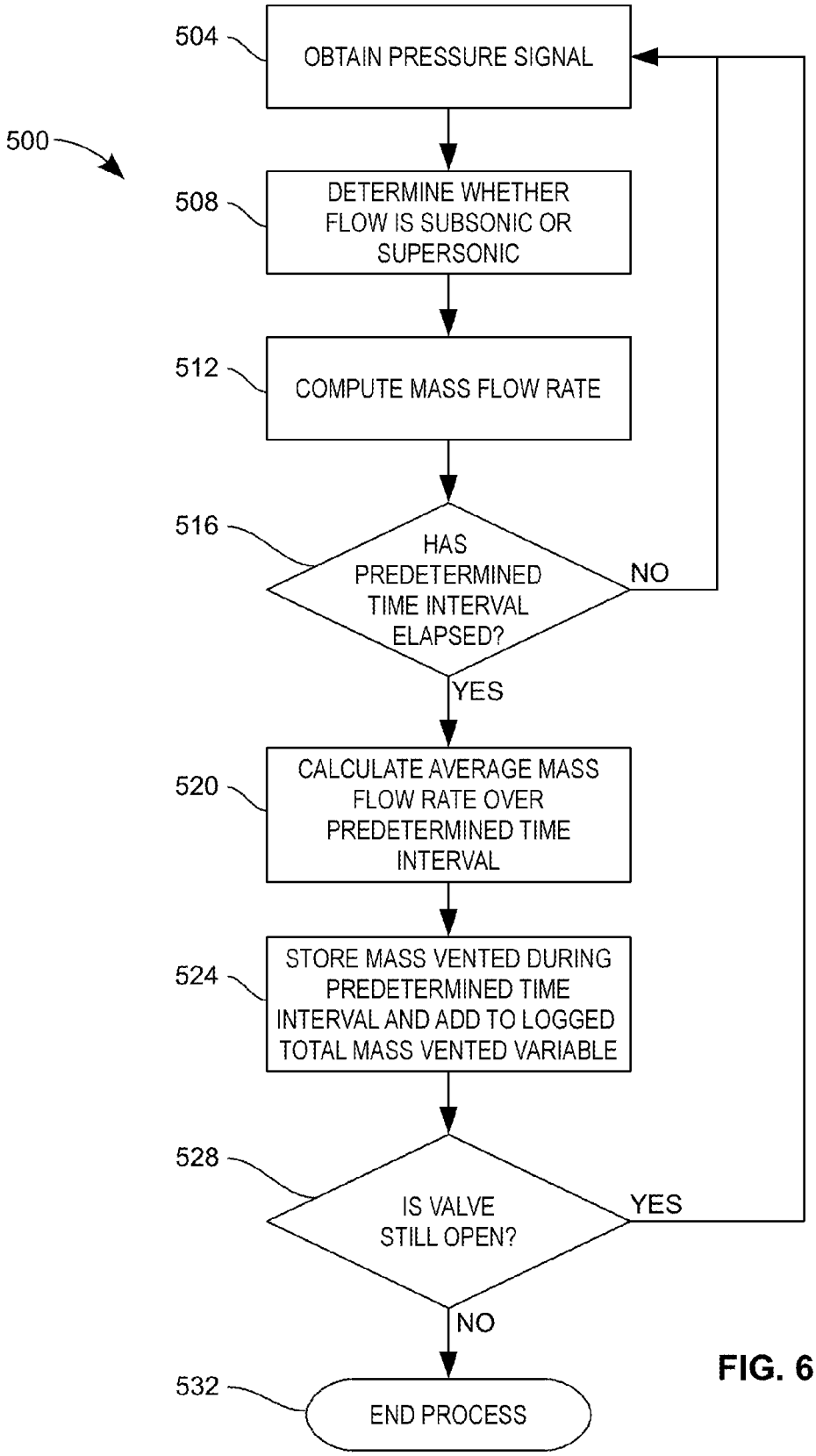
FIG. 6 is a process diagram of a method of determining the total mass vented from an air conditioning system during a venting operation.

FIG. 6 illustrates a method 500 of tracking the total mass of refrigerant vented during a venting operation. The processor 352 is configured to execute programmed instructions stored in the memory 356 to operate the components in the ACS system 100 to implement the method 500. The process 500 begins with the controller obtaining the pressure signal (block 504). The pressure signal is obtained from a pressure transducer upstream of the orifices (e.g. orifices 196 and 204). In the example of FIG. 3, the pressure signal is obtained from the pressure transducer 132 or 148 corresponding to the inlet valve 180 or 184, respectively, that is open.

The processor then determines whether the flow is subsonic or supersonic (block 508). As discussed above, the flow is subsonic if the upstream pressure is less than approximately 1.9 times atmospheric pressure, while the flow is supersonic if the upstream pressure is greater than approximately 1.9 times atmospheric pressure. The controller then proceeds to compute the mass flow rate through the orifice (block 512) based on the mass flow rate equations discussed above. Next, the controller determines whether a predetermined time interval has elapsed using the timer associated with the controller (block 516). If the predetermined time interval has not elapsed, the process continues from block 504. In one particular embodiment, the sampling rate is 0.2 seconds, and the predetermined time interval is one second, such that the blocks 504-516 are repeated five times before advancing to the next step.

Once the predetermined time interval has passed, the controller calculates the average mass flow rate over the predetermined time interval (block 520) based on the previously computed mass flow rates. The controller then determines the vented mass, which is the product of the average mass flow rate and the predetermined time interval. The controller stores the vented mass in the memory and adds the vented mass to a total mass vented variable, which is a running variable to which the vented mass is added at each cycle during the venting operation, in the memory (block 524).

The controller then proceeds to determine whether the valve is still open (block 528). If the valve is still open, the venting process is ongoing and the process then continues at block 504. As discussed above, if the valve has been closed, the venting process has been terminated and the process for determining the mass vented ends (block 532).

In some embodiments, the controller is configured to determine the total mass vented without averaging the mass flow rate over a predetermined time. Instead of performing the steps in blocks 516 and 520, the controller merely determines the mass flow rate of the refrigerant during the single sampling interval. The determined mass flow rate is then multiplied by the time between sampling intervals to obtain the mass vented, and the mass vented during the single sampling interval is added to the total mass vented variable.

In some embodiments, the processes described above with reference to FIGS. 5 and 6 may be performed concurrently by the ACS system. In other embodiments, the system operation may be performed as in process 400, while the mass determination is performed using a different process. In still other embodiments, the vented mass may be determined as in the method 500, while the operation of the system is performed using a different process.

Figure 7:
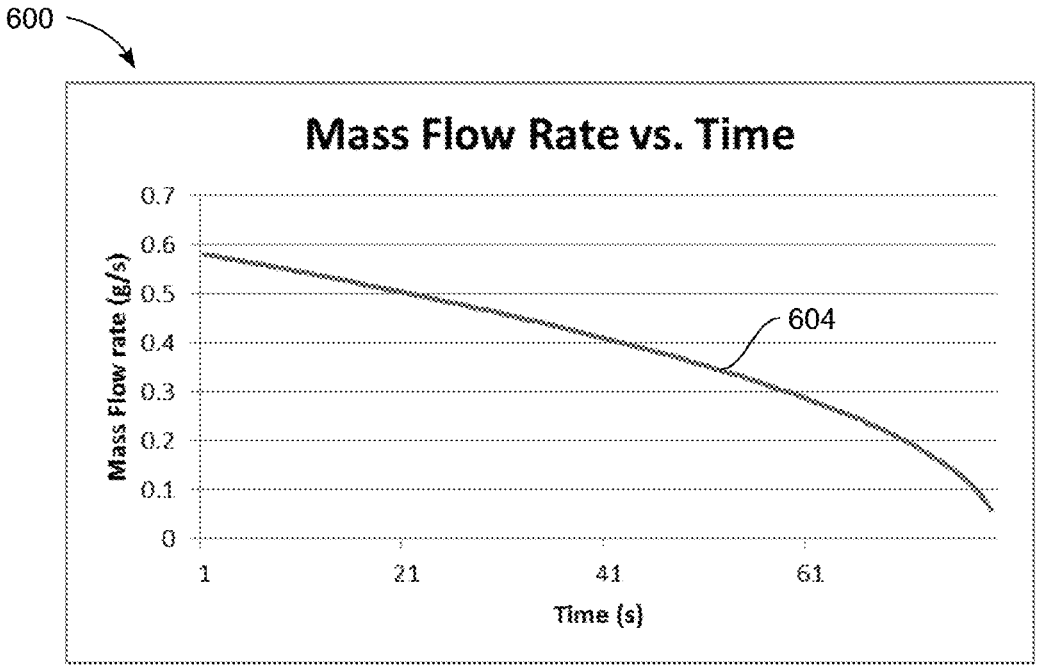
FIG. 7 is a graph showing the mass flow rate versus time for a simulation of a venting process.

FIG. 7 illustrates a graph 600 of theoretical mass flow rate 604 versus time for a simulation of a venting process for venting carbon dioxide from an air conditioning system. The simulation assumed that a constant 10 psi was lost from the air conditioning system each second until no carbon dioxide remained in the system. As can be seen from FIG. 7, the mass flow rate 604 through the orifice decreases over time as the upstream pressure drops.

Figure 8:
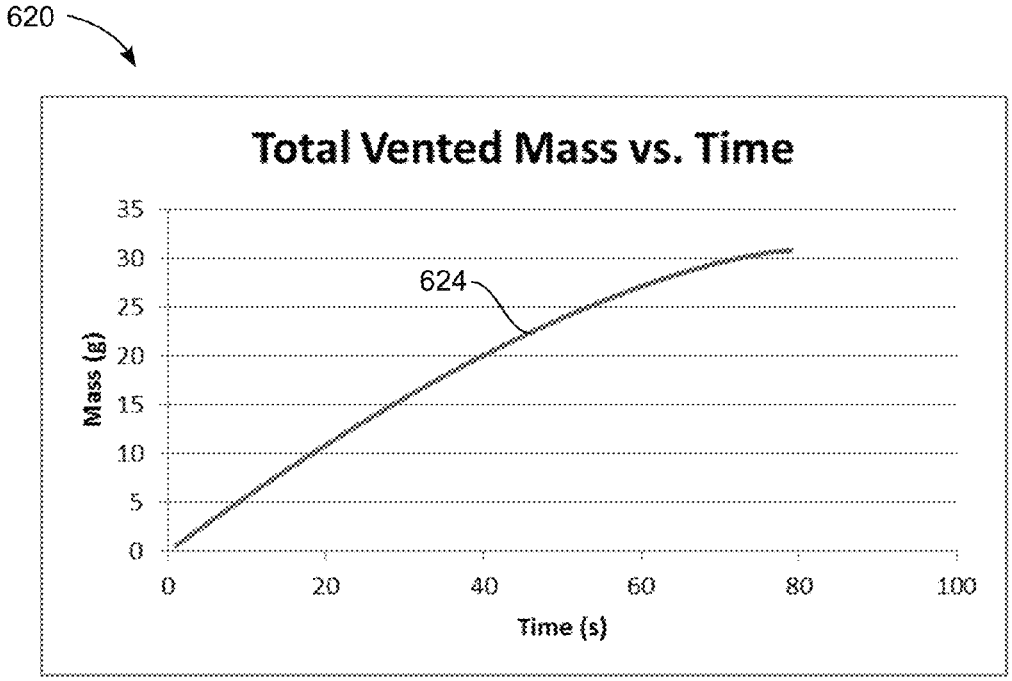
FIG. 8 is a graph showing the total mass vented versus time for the simulation depicted in FIG. 7.

FIG. 8 illustrates a graph 620 of the total mass vented 624 over time for the same simulation as FIG. 7. As the mass flow rate decreases due to pressure decrease in the system, the slope, or rate of mass loss in the system, decreases. In the simulation illustrated in the graphs of FIGS. 7 and 8, approximately 30.75 grams of carbon dioxide was vented in about 78 seconds.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. An air conditioning service system comprising:

an inlet port configured to connect to an air conditioning system to receive refrigerant;

a discharge circuit including a plurality of discharge lines arranged in parallel with one another, each of the plurality of discharge lines fluidly connecting the inlet port to the atmosphere through an associated orifice having a cross-sectional area to vent the refrigerant to atmosphere, and a plurality of discharge valves, each of which is associated with one of the plurality of discharge lines and is configured to open and close the associated one of the plurality of discharge lines;

a pressure transducer configured to sense a pressure at the inlet port; and a controller operably connected to the pressure transducer and to each of the plurality of discharge valves, the controller including a memory and a processor configured to execute program instructions stored in the memory to obtain the sensed pressure at the inlet port and determine a theoretical mass flow rate through each of the plurality of discharge lines based upon the sensed pressure and the cross-sectional area of the associated orifice, and to operate selected ones of the plurality of discharge valves based upon the determined theoretical mass flow rates.

2. The air conditioning service system of claim 1, wherein the controller is configured to determine a first set of the plurality of discharge valves having a combined theoretical flow rate that is less than a predetermined maximum flow rate, and to operate the first set of the plurality of discharge valves to open.

3. The air conditioning service system of claim 2, wherein the controller is configured to determine the first set of the plurality of discharge valves such that the total theoretical flow rate of the valves of the first set is a maximum possible combined theoretical flow rate that is less than the predetermined maximum flow rate.

4. The air conditioning service system of claim 2, wherein the controller is further configured to determine a first mass flow through the first set of the plurality of discharge valves during a first time period, and to store the mass flow in the memory.

5. The air conditioning service system of claim 4, wherein the controller is further configured to determine a total mass by summing a plurality of mass flows determined during a venting operation.

* * * * *